United States Patent [19]

del Valle

[11] 4,245,978

[45] Jan. 20, 1981

[54] GAS BURNER CONTROL SYSTEM

[76] Inventor: Leon del Valle, 10924 Aletta Ave., Culver City, Calif. 90213

[21] Appl. No.: 957,110

[22] Filed: Nov. 2, 1978

[51] Int. Cl.³ ..... F23N 5/00

[52] U.S. Cl. ..... 431/72; 431/22

[58] Field of Search ..... 431/22, 72, 76

[56] References Cited

U.S. PATENT DOCUMENTS 4,078,880 3/1978 Hunziker ..... 431/76

*Primary Examiner*—Carroll B. Dority, Jr.

*Attorney, Agent, or Firm*—Ben E. Lofstedt

[57] ABSTRACT

An improved gas burner control system which eliminates the need for a pilot light for operation of a gas burner, including a pair of gapped electrical conductors forming a set of ignition points disposed adjacent to a gas burner, a sensor for detecting the presence of the gas to be burned via the gas burner adjacent to the gas burner, means for electrically coupling the sensor means to a relay, the relay controlling the delivery of electrical current to a second relay, the second relay operable in an alternating fashion, means for electrically interconnecting the points of the alternating relay to the pair of ignition points, means for electrically controlling the flow of gas to the gas burner concurrently with the sensing of the existence of gas flowing out of the gas burner by the gas sensor, the alternating relay being operable upon the detection by the sensor means of the flow of gas from the gas burner, remote means for visually indicating if the electrically controlled valve is open, and means for indicating temperature.

3 Claims, 2 Drawing Figures

GAS BURNER CONTROL SYSTEM

BACKGROUND OF THE INVENTION

1. FIELD OF THE INVENTION:

This invention relates to gas burner control systems, and more particularly to, gas burner control systems with non-continuous gas pilot lights.

2. DESCRIPTION OF THE PRIOR ART:

The prior art contains examples of gas burner control systems which employ non-continuous gas pilot lights.

Such non-continuous gas pilot lights are desirable for a number of reasons, but, primarily because of the improved safety feature offerred by the use of such pilot lights.

Open flame pilot lights pose a safety problem in that the generally hidden flame can ignite gas fumes from a gas leak, volatile hydrocarbon solutions, such as gasoline, paint thinners, nail polish remover and the like which are frequently used in and about the home where gas burner control systems find the greatest use. Gas burner control systems are found in gas stoves, gas heaters and gas water heaters.

A further undesirable problem associated with such systems is the fact that is continually consumes the oxygen in the air. Consequently, it is dangerous to use in a people-occupied closed environment such as a room with no ventilation, a closed cabin, camper, or motorhome because it can consume so much of the oxygen as to suffocate the persons in such a closed environment.

Another complaint which is frequently voided concerning the use of such continuous burning systems is that it is energy wasteful. Such as waste of energy cannot be condoned in our present energy-conscious World.

Consequently, non-continuous gas pilot lights are preferred over the continuous burning types.

One type of non-continuous gas pilot light uses a piezoelectric device which when mechanically stressed and rapidly released produces a voltage of several thousand volts thereby causing an electric arc to be generated for igniting the gas burner.

While such devices represent an improvement over the continuous burning gas pilot lights, such piezoelectric elements are fragile and having a definite life-cycle.

The present invention as disclosed hereinafterwards offers another alternative to the above-mentioned non-continuous gas pilot light device.

SUMMARY OF THE INVENTION

The fundamental invention disclosed herein is an improved gas burner control system which eliminates the need for a continuous burning gas burner pilot light and comprises a pair of gapped electrical conductors forming a set of ignition points disposed adjacent to a gas burner, a sensor for detecting the presence of the gas to be burned via the gas burner adjacent to the gas burner, means for electrically coupling the sensor means to a relay, the relay controlling the delivery of electrical current to a second relay, the second relay operable in an alternating fashion, means for electrically interconnecting the points of the alternating relay to the pair of ignition points, means for electrically controlling the flow of gas to the gas burner concurrently with the sensing of the existence of gas flowing out of the gas burner by the gas sensor, the alternating relay being operable upon the detection by the sensor means of the flow of gas from the gas burner, remote means for visually indicating if the electrically controlled valve is open, and means for indicating temperature.

OBJECTS OF THE INVENTION

It is a principal and primary object of the instant invention to provide a new and unproved non-continuous gas pilot light control system for gas burner systems.

One object of the present invention is to provide a new and novel non-continuous gas pilot light which uses substantially less gas than a continuous gas pilot light gas burner ignition system.

Another important and primary object of the subject invention is to provide an improved gas pilot light control system which is safer and less hazardous than the continuous burning types found in the prior art.

A yet still further and primary object of the instant invention is to provide a more economical gas pilot control system than those devices typically found in the prior art.

Another object of the present invention is to provide a more reliable gas pilot ignition and gas burner control system.

The various features of novelty which characterize this invention are pointed out with particularity in the claims annexed to and forming a part of this Specification.

For a better understanding of the invention, however, its advantages, and specific objects of its use, reference should be had to the accompanying drawings and descriptive matter in which have been illustrated and described the preferred embodiments of the invention.

DESCRIPTION OF THE PREFERRED EMBODIMENT OF THE INVENTION

Prior to launching into a detailed and informative disclosure of the preferred embodiments envisioned for the present invention, it is to be clearly understood that the instant invention is not limited in any way in its application, to the details of construction and arrangement of parts illustrated in the accompanying drawings, since the subject invention is readily capable of other various and diverse ways. It should be further understood that the particular phraseology or terminology employed herein is merely for the sole purpose of description and is not intended to be limiting in any way, form or fashion.

Figure 2:
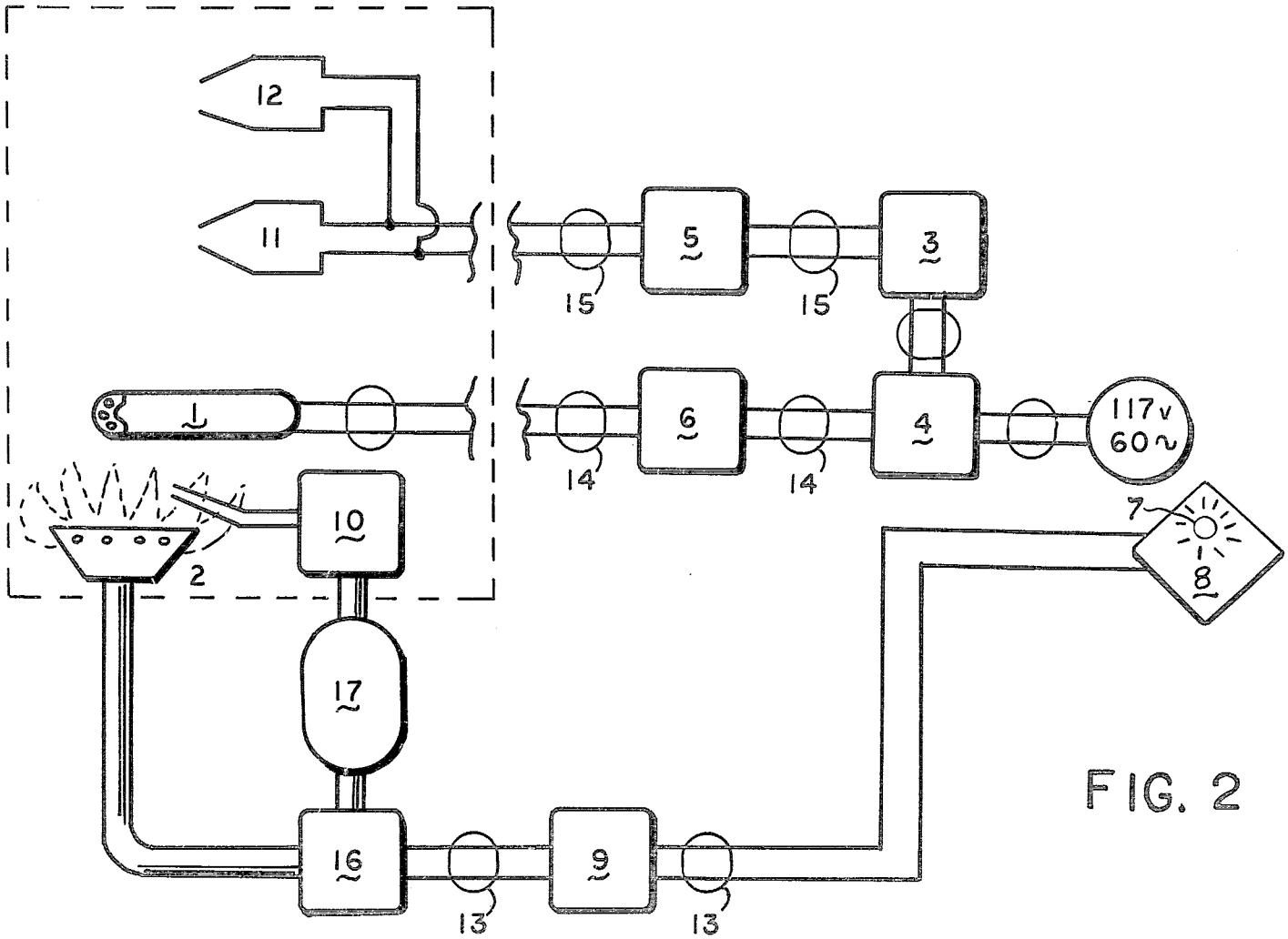
FIG. 2 is a functional block diagram of the present invention.

With continued reference now to the drawings and with special emphasis now on FIG. 2, there is depicted therein a functional block diagram of the invention disclosed herein.

Basically, the invention disclosed herein is an improved gas pilot control system comprising a gas sensor 1 for sensing the presence of gas from the gas burner 2 so that when gas is sensed by the gas sensor 1, an electrical signal is generated, a double pair of ignition points 11 and 12, control cables 14 for delivering the electrical signal from the gas sensor 1 when gas is sensed by the gas sensor 1 to an electrical isolating and voltage stepup transformer 6 to the sensor relay 4; all of which are electrically powered by the 117 volt, 60 Hertz alternating current source, control cables 15 for the double pair of ignition points 11 and 12, a transformer 5 for increasing the voltage to the double pair of ignition points 11 and 12 from the ignition points of an alternating relay 3, a sensor relay 4 activated by an electrical signal from the gas sensor 1 and delivered to sensor relay 4 by transformer 6 for delivering the 117 volts, 60 hertz voltage to the alternating relay 3 and for powering the gas sensor 1. Further, a temperature control and gas control valve position indicating light 8 typically manually adjustable, is included which controls the gas control valve 16 via an appropriate electrical isolation transformer 9 which is electrically coupled thereto via the control cables 13. Once the gas valve 16 is turned "ON", gas is delivered to the gas burner 2 from the gas supply 17, the existing manually operable gas pilot valve 10 is turned "off" so that no gas is delivered therethrough. In the prior art, the gas pilot valve 10 is typically always "on" with gas flowing through it with it ignited manually to always present a small "pilot" flame above the gas burner 2 so that when the valve 16 is turned "on" to permit gas to flow from the gas supply 17 through the valve 16 to the gas burner 2, the gas eminating from the gas burner 2 will be ignited by the small flame of the pilot valve 10. However, in the present system disclosed herein, the pre-existing pilot valve 10 is not used; it is merely turned "off".

Figure 1:
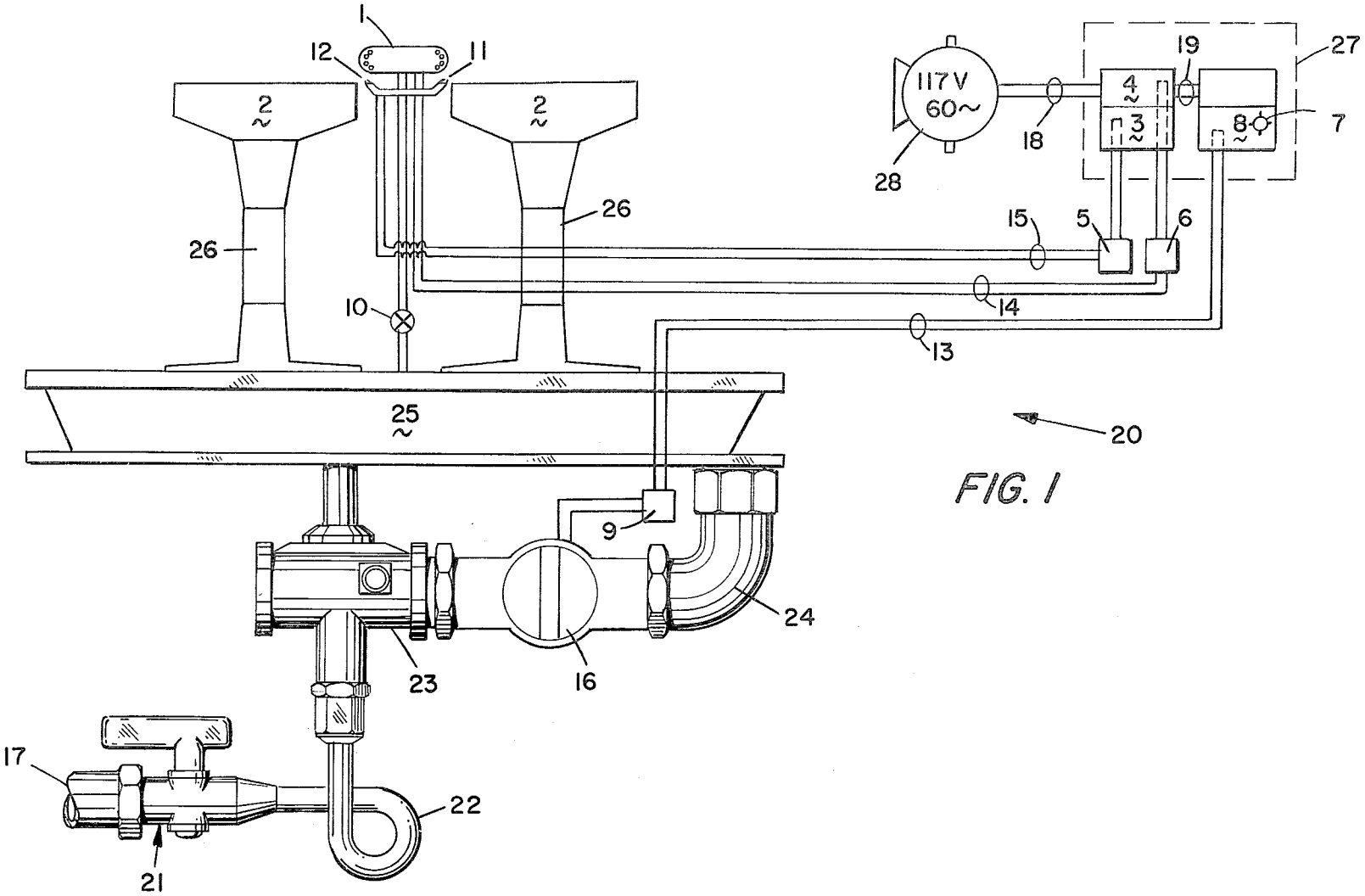
FIG. 1 is a combination diagrammatic and schematic view of the various elements and their inter-relationships of the present invention.

In addition to elements 1–17 shown and described in FIG. 2, there is further shown and described in FIG. 1 the following elements of the over-all system which functions in conjunction with the present invention of the instant application. An electrical generating source 28 provides a source of 117 volt, 60 Hertz electrical power and this electrical power is delivered to the sensor relay 4 via electrical supply cables 18. The sensor relay 4, the ignition points relay 3, the gas valve temperature control 8 and light 7, and additional electrical supply cables 19 are housed typically in a common housing 27, located remotely from the balance of the gas burner system, depicted generally at 20. Electrical wiring denominated as "control cables" are identified at 13, 14 and 15. Control cable 13 operatively couples the gas valve temperature central 8 and indicating light 7 with the electrical isolating and voltage control transformer 9, which, in turn, is operatively coupled to the gas control valve 16. When the gas control valve 16 is turned "on", gas from the gas supply 17 is fed into a manually operable valve 21, and when valve 21 is opened, the gas is delivered to the "T" 23 via the gas pipe 22. The "T" 23 is left over from the typical "old gas system", and could, in a new system using the present invention herein, be replaced by a single elbow, such as shown at 24. Thereafterwards, the gas is delivered through the gas control valve 16 to the pipe elbow 24, and into the gas burner manifold 25. Once the gas is in the manifold 25, it is distributed, under pressure, to the connecting pipes 26 and into the gas burners 2.

It should be noted, at this time, that FIG. 1 is functionally and structurally identical to FIG. 2. The only difference is that FIG. 1 is a pictorial/diagrammatic representation of the new and improved system forming the essence of the invention disclosed herein and FIG. 2 is a block/functional diagram only of the new and improved system forming the essence of the invention herein.

Operationally speaking, the gas valve 16 is turned "ON" via the temperature control 8, thereby causing the gas from the gas supply 17 to be delivered to the gas burner 2. The position of the gas control valve 16 is indicated by the indicating light 7. For example, when the indicating light is illuminated, the light would indicate that the gas control valve 16 is open and gas is flowing through it. The gas sensor 1 which is disposed in close proximity to the gas burner 2 detects the presence of the gas escaping from the gas burner 2 and delivers an electrical signal via the control cables 14 to the electrical isolating and voltage step-up transformer 6. In turn, the signal from the transformer 6 is delivered to the sensor relay 4 which is turned "ON". Once the sensor relay 4 is "ON", the alternating voltage is delivered to the ignition points control relay 3, and causes the alternating voltage to be delivered directly to the electrical voltage step-up and isolation transformer 5 in an alternating fashion. An alternating voltage must be employed in order to allow the transformer 5 to be stepped up from the 117 volts to several thousand volts. Several thousand volts is then electrically conducted to the double pair of ignition points 11 and 12.

Once this is accomplished, the voltage is caused to pump across the ignition points 11 and 12, thereby providing an ignition means for the gas burner 2, and igniting the gas eminating therefrom.

While a specific embodiment of the invention has been shown and described in detail to illustrate the application of the principles of the invention, it will be understood that the invention may be embodied otherwise without departing from such principles.

What is claimed is:

1. An improved gas burner control system which eliminates the need for a pilot light for operation of a gas burner, comprising:

(a) A source of gas;

(b) A gas burner;

(c) Electrically operable valve means operably interconnected between the source of gas and the gas burner for controlling the flow of gas therebetween;

(d) Temperature sensing and valve control means for detecting temperature of the operatively associated with the valve, environment, and for controlling the valve relative to the temperature detected;

(e) A pair of gapped electrical conductors forming a set of ignition points disposed adjacent to the gas burner;

(f) A gas sensor for detecting the presence of gas eminating from the gas burner to be burned disposed adjacent to the gas burner, the gas sensor controlling an electrical signal characteristically indicative of the presence or absence of gas therefrom;

(g) Means for electrically coupling the sensor means to a first relay, the first relay being complementarily responsive to the electrical signal from the gas sensor;

(h) Means for electrically powering the first relay;

(i) A source of electrical energy operatively associated with the first relay, whereby the first relay controls the transfer of the electrical energy;

(j) A second relay operatively associated with the first relay for receiving the transfer of electrical energy therefrom and for controlling the deliverty thereof, in alternative fashion, to the pair of ignition points; and (k) Means for operatively coupling the output of the second relay to the pair of points.

2. The improved gas burner control system of claim 1, further comprising means remote from the gas burner for visually indicating if the electrically control valve is open or closed.

3. The improved gas burner control system of claim 2, further comprising a second set of gapped electrical conductors forming a set of ignition points disposed adjacent to the gas burner and means for operatively associating the second set of gapped electrical conductors with the second relay for receiving the transferred electrical energy therefrom.

* * * * *